US011773576B2

(12) United States Patent
Huang et al.

(10) Patent No.: US 11,773,576 B2
(45) Date of Patent: Oct. 3, 2023

(54) PRESSURE FLUSHING SYSTEM AND TOILET

(71) Applicant: ECO (XIAMEN) TECHNOLOGY INC., Fujian (CN)

(72) Inventors: Bingxing Huang, Fujian (CN); Jun Huang, Fujian (CN); Donghsheng Zhang, Fujian (CN); Xiping Li, Fujian (CN); Jianfu Wu, Fujian (CN); Jinding Dai, Fujian (CN)

( * ) Notice: Subject to any disclaimer, the term of this patent is extended or adjusted under 35 U.S.C. 154(b) by 107 days.

(21) Appl. No.: 17/612,232

(22) PCT Filed: Sep. 29, 2019

(86) PCT No.: PCT/CN2019/109061

§ 371 (c)(1),
(2) Date: Nov. 18, 2021

(87) PCT Pub. No.: WO2021/022652

PCT Pub. Date: Feb. 11, 2021

(65) Prior Publication Data

US 2022/0243440 A1 Aug. 4, 2022

(30) Foreign Application Priority Data

Aug. 7, 2019 (CN) ..... 201910725923.6

(51) Int. Cl.

| | |
|---|---|
| ***E03D 1/28*** | (2006.01) |
| ***E03D 1/30*** | (2006.01) |
| ***E03D 1/34*** | (2006.01) |
| ***E03D 3/10*** | (2006.01) |

(52) U.S. Cl.

CPC ..... *E03D 1/286* (2013.01); *E03D 1/302* (2013.01); *E03D 1/34* (2013.01); *E03D 3/10* (2013.01)

(58) Field of Classification Search

USPC ..... 4/332

See application file for complete search history.

(56) References Cited

U.S. PATENT DOCUMENTS

| | | | | |
|---|---|---|---|---|
| 6,834,399 | B1 * | 12/2004 | Lo | E03D 3/10 4/359 |
| 11,427,994 | B2 * | 8/2022 | Jensen | E03D 3/10 |
| 2021/0355667 | A1 * | 11/2021 | Jensen | E03D 3/10 |

* cited by examiner

*Primary Examiner* — Christine J Skubinna

(57) ABSTRACT

A pressure flushing system including a first container and a second container, and a communicating member that communicates with the first container and the second container; the first container is formed with a first water inlet and a drain, water flows into the first container from the first water inlet, and water in the second container flows in from the first container by means of the communicating member; gas in the first container and the second container is gradually compressed and stored in an upper part of the second container during a water intake process, and the compressed gas pushes the water in the first container and the second container to be discharged from the drain when draining. The present invention solves the disadvantages of the large volume and inconvenient installation of pressure water tank that have existing structures, and has the characteristics of a small volume and flexible installation.

16 Claims, 15 Drawing Sheets

PRESSURE FLUSHING SYSTEM AND TOILET

BACKGROUND OF THE INVENTION

The present invention relates to sanitary ware and more particularly pertains to a pressure flushing system and toilet.

A toilet generally includes two parts, a seat body and a water tank, wherein the water tank is installed with a flushing system therein to flush the toilet. The commonly used flushing system uses the principle of gravity, that is, converting water's gravitational potential energy into water's kinetic energy to flush the toilet. However, this flushing system requires a large amount of water, and the water tank must be raised to a certain height, otherwise the flushing effect cannot be achieved.

At present, there is a pressure flushing system on the market. By setting a pressure water tank, the pressure energy accumulated by the compressed gas in the pressure water tank is used to make the water in the pressure water tank generate a strong flushing force when released, so as to achieve the effect of flushing the toilet. Since this pressure flushing system uses pressure energy for flushing, the ideal flushing effect can be achieved with a small amount of water, which is energy-saving and environmentally friendly. For toilets equipped with pressure flushing systems, the pressure water tank is usually placed in a ceramic space behind the seat. In terms of the appearance of the entire toilet, the position of the seat ring at the front of the seat body is aligned with the rear. For the in-wall installation method, the ceramic space behind the toilet seat is limited, while the water chamber and air chamber of the pressure water tank of the existing structure are integrated, which is large in size and occupies a large space, making the installation process extremely inconvenient. The pressure water tank will even encroach on the installation space of other components.

BRIEF SUMMARY OF THE INVENTION

An object of the present invention is to provide a pressure flushing system and a toilet, which overcomes the disadvantages of large volume and inconvenient installation of pressure water tanks that have existing structures, and has the characteristics of small volume and flexible installation.

To attain the above objects, the solutions of the present invention are as follows:

A pressure flushing system comprises a first container, a second container and a communicating member that communicates with the first container and the second container. The first container is formed with a first water inlet and a drain. Water flows into the first container from the first water inlet, and the water from the first container flows into the second container through the communicating member. Gas in the first container and the second container is gradually compressed and stored in an upper part of the second container during a water intake process, and the compressed gas pushes the water in the first container and the second container to be discharged from the drain when draining.

The communicating member has a first end which is arranged at a top part of the first container and a second end which extends into an interior of the second container and is close to a bottom part of the second container.

The pressure flushing system further comprises a drain valve which is arranged in the first container to open or close the drain.

The pressure flushing system further comprises an opening valve for controlling pressure relief of the drain valve.

The opening valve comprises a valve body, an opening assembly and an overpressure protection assembly. The valve body is formed with a water inlet cavity and a water outlet cavity, and the water inlet cavity and the water outlet cavity are communicated through a first through hole. The water inlet cavity is provided with a first water inlet pipe communicating with the drain, and the water outlet cavity is provided with a first water outlet pipe. The opening assembly is arranged relative to the first through hole and opens or closes the first through hole. Pressure of the drain is relieved when the first through hole is opened. The water inlet cavity is formed with a pressure relief hole. The overpressure protection assembly is arranged relative to the pressure relief hole and closes the pressure relief hole, and opens the pressure relief hole when pressure of the water inlet cavity is greater than a preset value. When the pressure relief hole is opened, the water inlet cavity and the first water outlet pipe are in communication with each other.

The first through hole and the pressure relief hole are both arranged vertical to a direction of inlet water flow, and the pressure relief hole is arranged upstream of the inlet water flow relative to the first through hole.

The pressure flushing system further comprises a water outlet box. The water outlet box comprises a water outlet box main body and a first one-way valve assembly. The water outlet box main body is formed with a water-passing cavity, a second water inlet, at least one water outlet and a vent, with the second water inlet, the water outlet and the vent all being in communication with the water-passing cavity, and the second water inlet is in communication with the drain. The first one-way valve assembly is arranged relative to the second water inlet to open or block the second water inlet. When the pressure flushing system finishes flushing, the first one-way valve assembly blocks the second water inlet. The vent is arranged at a top part of the water-passing cavity and is open to atmosphere.

The water outlet box main body is provided with several second water inlet pipes in communication with functional devices of the pressure flushing system, and the second water inlet pipes are in communication with the water cavity to realize pressure relief or water discharge of the functional devices. The functional devices comprises at least one of the drain valve, the opening valve, a solenoid valve and a pressure stabilizing valve of the pressure flushing system.

The water-passing cavity is divided into a first cavity and a second cavity. The second cavity is located above the first cavity, and a second through hole is provided between the first cavity and the second cavity. The second water inlet and the water outlet are both in communication with the first cavity, wherein the second water inlet is provided relative to the second through hole. The vent is provided at a top part of the second cavity, and the second water inlet pipes are in communication with the second cavity. The first one-way valve assembly is provided relative to the second through hole to open or block the second through hole. When the pressure flushing system starts flushing, the first one-way valve assembly blocks the second through hole.

The second container is provided with an adjusting device therein. The adjusting device comprises a water-gas partition that divides the second container into a water chamber and an air chamber, and an exhaust adjustment assembly. The water-gas partition is provided with an air outlet communicating with the water chamber and the air chamber of the second container. The exhaust adjustment assembly is arranged relative to the air outlet and movably adjusts exhaust volume of the air outlet. The water-gas partition is formed with a third through hole for the communicating member to pass through, and the communicating member cooperates with the third through hole in a sealed manner.

A toilet is provided with an accommodating cavity, a flushing pipe and the pressure flushing system. The pressure flushing system is installed in the accommodating cavity, and the drain of the first container is in communication with the flushing pipe of the toilet.

The accommodating cavity is formed at a rear part of the toilet, and the first container and the second container are located on two sides of toilet sewage pipe respectively.

Beneficial Effects

After adopting the above structure, the present invention overcomes the disadvantages of large volume and inconvenient installation of existing pressure water tanks by dividing the existing pressure water tank into the first container and the second container which are independent from each other. The first container and the second container are installed independently of each other, making the assembly more convenient and flexible, and more suitable for toilets with small volume requirements. The first container is used as a water chamber and the second container is used as a water-gas mixing chamber, so that the water storage volume is larger. Under the condition of the same water storage volume, the total volume of the first container and the second container is smaller, which further meets the small volume requirement of some toilets.

In addition, the opening valve of the present invention can be manually controlled to realize the drainage of the pressure flushing system, which can save energy, reduce production costs, and allow the pressure flushing system to have an overpressure protection function. The water outlet box can realize the anti-siphoning function and diversion function of the pressure flushing system. With the adjusting device, the water storage structure can adjust the drainage speed according to the demand, and the compatibility between the water storage structure and toilets of different pipe types can be improved. It has the advantages of simple structure and convenient operation.

DESCRIPTION OF THE NUMBERS IN THE FIGURES

Figure 1:
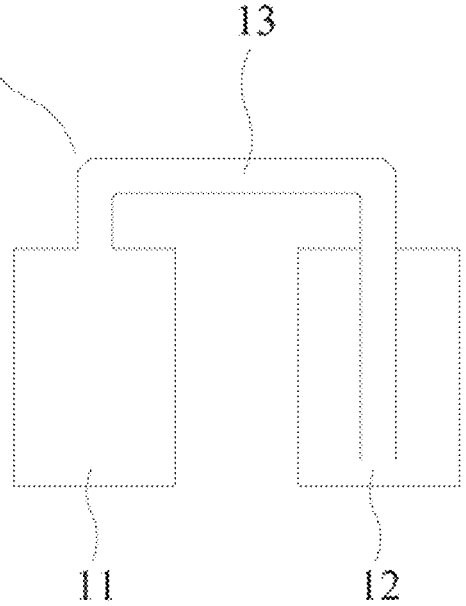
FIG. 1 is a schematic structural view of the water storage structure of the present invention.

1: Water storage structure; 11: First container; 111: First water inlet; 112: Drain; 12: Second container; 13: Communicating member; 2: Combination valve; 3: Drain valve; 31: Piston; 4: Opening valve; 41: Valve body; 411: Water inlet cavity; 4111: Pressure relief hole; 4112: First opening; 412: Water outlet cavity; 4121: Second opening; 413: First through hole; 414: First water inlet pipe; 415: First water outlet pipe; 42: Opening assembly; 421: Opening rod; 4211: First flange; 422: First sealing part; 423: First restoring spring; 424: Diaphragm; 425: Button guide post; 43: Back cover; 44: Back cover sealing ring; 45: Front cover; 451: Mounting hole; 46: Overpressure protection assembly; 461: Pressure relief cover; 4611: Spring fixing pole; 4612: Perforation; 462: Second restoring spring; 463: Second sealing part; 464: Pressure relief stand; 465: Pressure relief cover sealing ring; 5: Pressure stabilizing valve; 6: Water outlet box; 61: Water outlet box main body; 61A: Upper shell; 61B: Lower shell; 611: Water-passing cavity; 611A: First cavity; 611B: Second cavity; 612: Second water inlet; 613: Water outlet; 614: Vent; 615; Second through hole; 616: Discharge pipe; 617: Overflow groove; 618: Water blocking piece; 62: First one-way valve assembly; 621: Valve sheet; 622: Sealing rubber pad; 63: Second water inlet pipe; 64: Second water outlet pipe; 65: Second one-way valve assembly; 66: Third one-way valve assembly; 661: Movable member; 6611: Hook; 662: Sealing ring; 7: Adjusting device; 71: Water-gas partition; 711: Installation pipe; 7111: Air outlet; 7112: Installation step; 712: Third through hole; 72: Exhaust adjustment assembly; 721: Adjustment valve; 7211: Exhaust pipe; 7212: Air inlet; 7213: Second flange;

722: Adjusting rod; 723: Knob; 724: Adjustment valve sealing ring; 725: C-type buckle; 73: First sealing ring; 74: Second sealing ring; 100: Accommodating cavity; 200: Main flushing pipe; 300: Rim flushing pipe.

DETAILED DESCRIPTION OF THE INVENTION

In order to further explain the technical solutions of the present invention, the following will describe the present invention in detail through specific embodiments.

As shown in FIGS. 1 to 25, the present invention is a pressure flushing system and toilet. The pressure flushing system comprises a first container 11, a second container 12 and a communicating member 13 that communicates with the first container 11 and the second container 12. The first container 11 is formed with a first water inlet 111 and a drain 112. Water flows into the first container 11 from the first water inlet 111, and the water from the first container 111 flows into the second container 12 through the communicating member 13. Gas in the first container 11 and the second container 12 is gradually compressed and stored in an upper part of the second container 12 during a water intake process, and the compressed gas pushes the water in the first container 11 and the second container 12 to be discharged from the drain 112 when draining. The details are as follows:

As shown in FIG. 1 which is a schematic structural view of the water storage structure 1 of the present invention, the water storage structure 1 comprises a first container 11 and a second container 12 that are installed independently of each other, and a communicating member 13 that communicates with the first container 11 and the second container 12. The communicating member 13 has a first end which is arranged at a top part of the first container 11 and a second end which extends into an interior of the second container 12 and is close to a bottom wall of the second container 12.

When the water storage structure 1 is in use, the first container 11 serves as a water chamber, the upper part of the second container 12 serves as an air chamber, a lower part of the second container 12 serves as a water chamber, and the communicating member 13 stores a small amount of air. When water enters the water storage structure 1, the water flow first enters the first container 11, and the first container 11 stores the water and squeezes the air inside the first container 11 upward. Most of the air is compressed in the second container 12 through the communicating member 13, and a small part of the air stays on an upper part of the communicating member 13. After the first container 11 is full of water, the water flow enters the second container 12 through the communicating member 13, and the second container 12 stores the water and further compresses and lifts up the air inside the second container 12, so that the air is stored and compressed in the upper part of the second container 12. When the water storage structure 1 drains the water, the water in the first container 11 is quickly discharged; and at the same time, pressure is relieved in the communicating member 13, and the air in the upper part of the second container 12 pushes the water in the lower part thereof to produce a siphon effect, so that the water in the lower part of the second container 12 is transported to the first container 11 and discharged.

The water storage structure 1 overcomes the disadvantages of large volume and inconvenient installation of existing pressure water tanks by dividing the existing pressure water tank into the first container 11 and the second container 12 which are independent from each other. The first container 11 and the second container 12 are installed independently of each other, making the assembly more convenient and flexible, and more suitable for toilets with small volume requirements. The first container 11 is used as a water chamber and the second container 12 is used as a water-gas mixing chamber, so that the water storage volume is larger. Therefore, under the condition of the same water storage volume, the total volume of the first container 11 and the second container 12 is smaller, which further meets the small volume requirement of some toilets.

Figure 2:
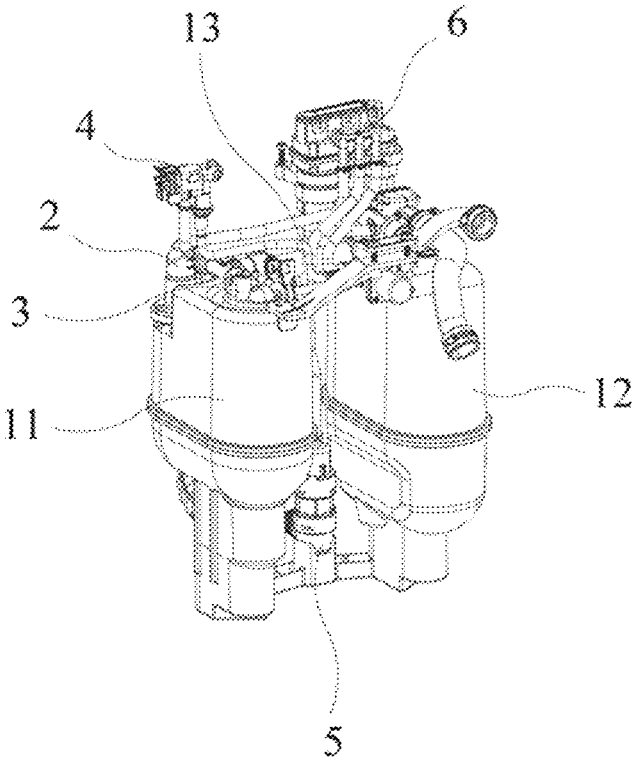
FIG. 2 is a perspective view of the pressure flushing system of the present invention.
Figure 3:
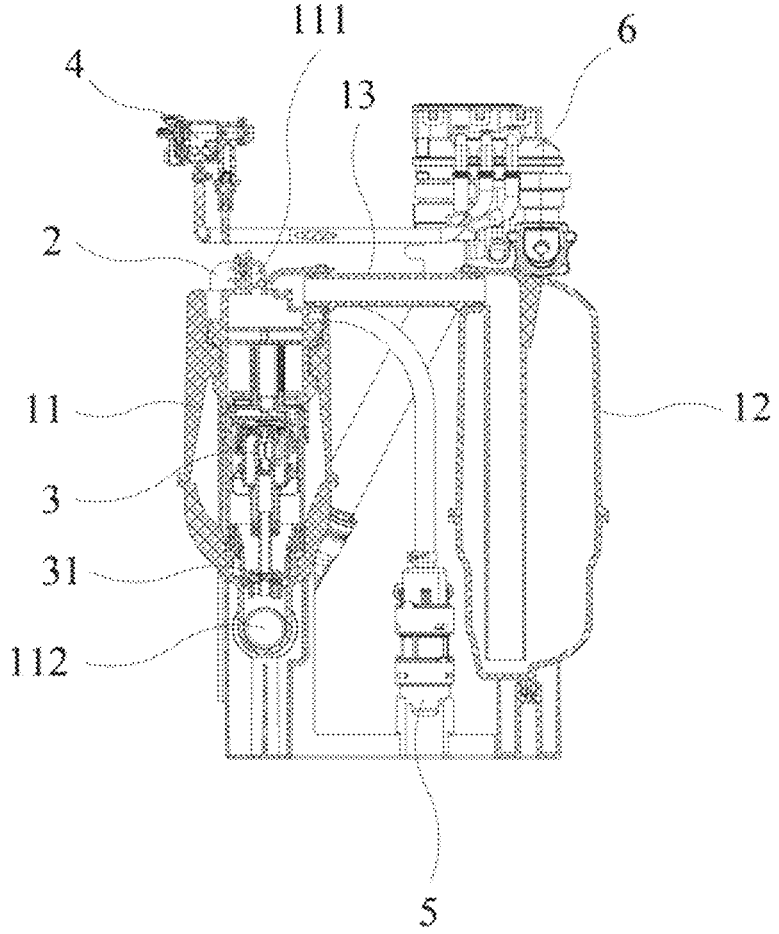
FIG. 3 is a schematic structural view of the first embodiment of the pressure flushing system of the present invention.
Figure 4:
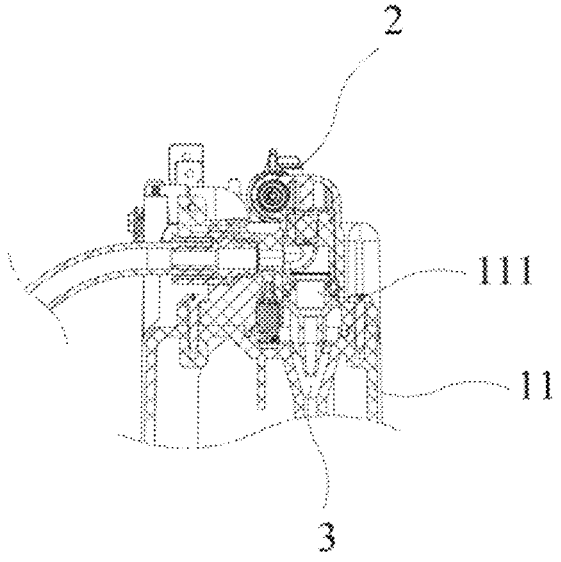
FIG. 4 is a cross-sectional view of the water intake part of the first embodiment of the pressure flushing system of the present invention.

As shown in FIG. 2, the water storage structure 1 can be applied to a pressure flushing system. As shown in FIGS. 3 and 4, the first embodiment of the pressure flushing system further comprises a combination valve 2, a drain valve 3 and an opening valve 4 apart from the water storage structure 1. The first container 11 is formed with the first water inlet 111 and the drain 112. The drain valve 3 is arranged relative to the drain 112, and the combination valve 2 is arranged relative to the first water inlet 111 to realize independent water inflow for the first container 11 and the drain valve 3. The opening valve 4 controls pressure relief or pressure storage of the drain valve 3 so that a piston 31 of the drain valve 3 opens or closes the drain 112.

Figure 5:
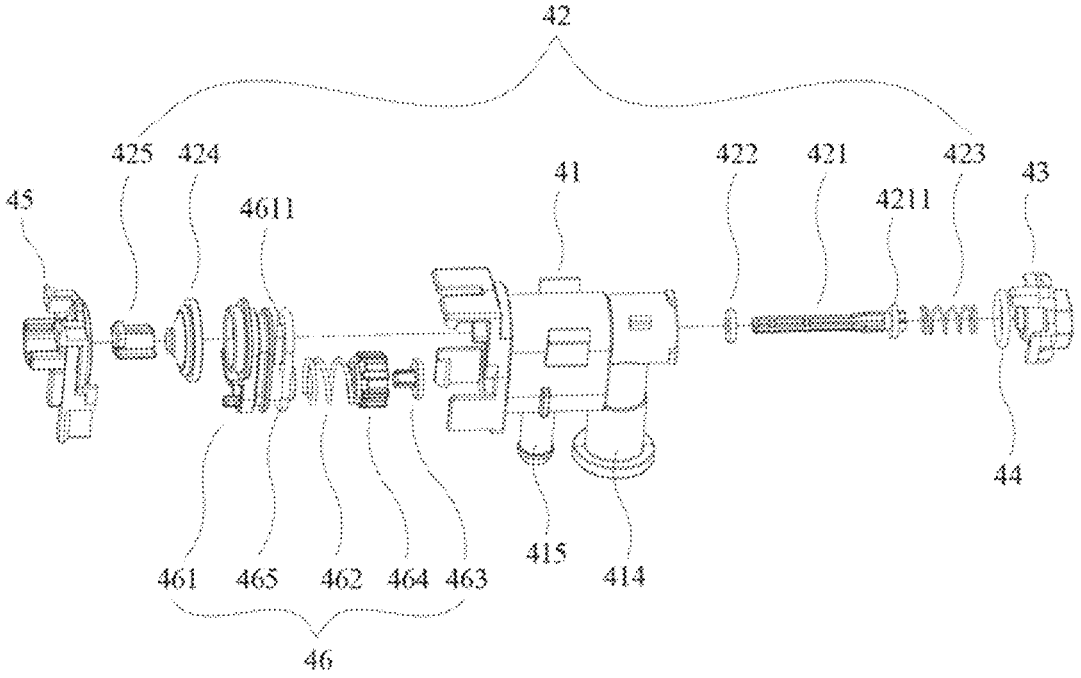
FIG. 5 is a dissembled view of the opening valve of the present invention.
Figure 6:
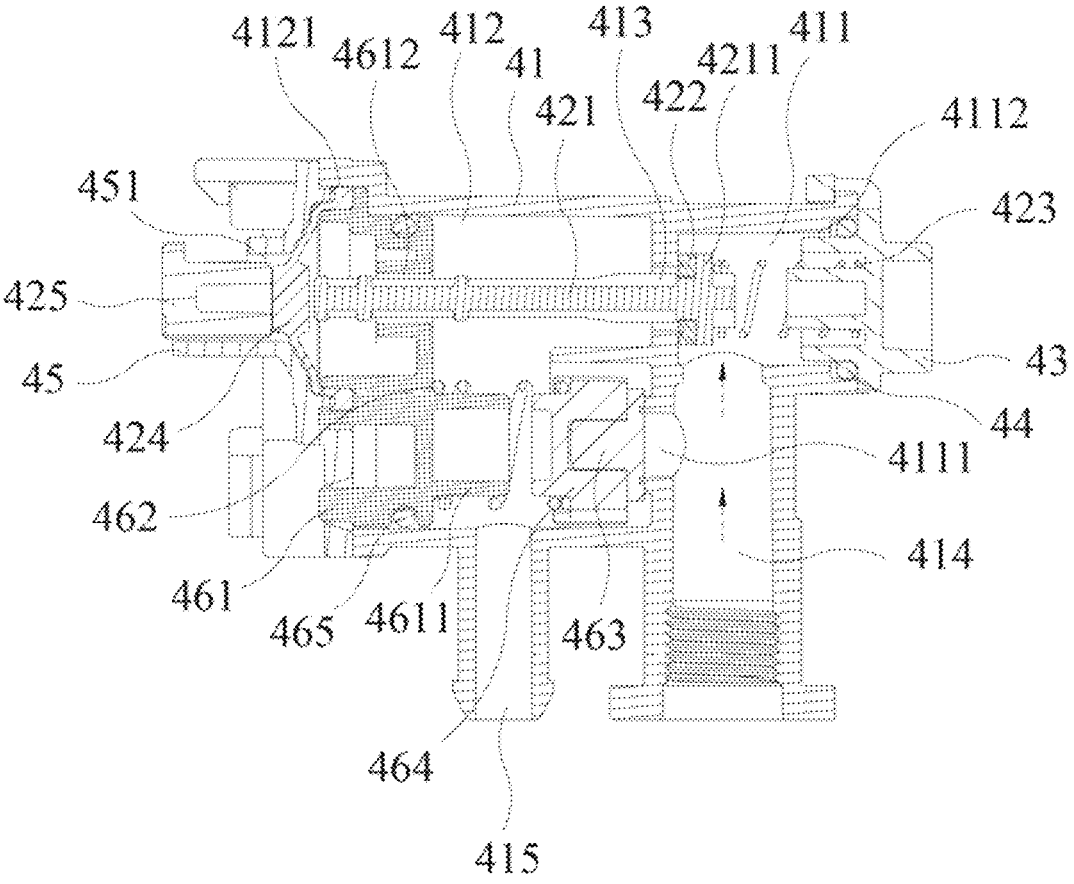
FIG. 6 is a schematic structural view of the closed state of the opening valve of the present invention.

An embodiment of the opening valve 4:

As shown in FIGS. 5 to 6, the opening valve 4 comprises a valve body 41, an opening assembly 42 and an overpressure protection assembly 46. The valve body 41 is formed with a water inlet cavity 411 and a water outlet cavity 412. The water inlet cavity 411 and the water outlet cavity 412 are communicated through a first through hole 413. The water inlet cavity 411 is provided with a first water inlet pipe 414 communicating with the drain 112, and the water outlet cavity 412 is provided with a first water outlet pipe 415. The opening assembly 42 is arranged relative to the first through hole 413 and opens or closes the first through hole 413. When the first through hole 413 is opened, pressure relief of the drain 112 of the water storage structure 1 is realized. The water inlet cavity 411 is formed with a pressure relief hole 4111. The overpressure protection assembly 46 is arranged relative to the pressure relief hole 4111 and closes the pressure relief hole 4111, and opens the pressure relief hole 4111 when pressure of the water inlet cavity 411 is greater than a preset value. When the pressure relief hole 4111 is opened, the water inlet cavity 411 and the first water outlet pipe 415 are in communication with each other.

The first through hole 413 and the pressure relief hole 4111 are both arranged vertical to a direction of inlet water flow. The pressure relief hole 4111 is arranged upstream of the inlet water flow relative to the first through hole 413. When the internal pressure of the water inlet cavity 411 is too high (in this embodiment, the water pressure is set to be greater than 3.5 kg), the pressure relief hole 4111 will be opened before the first through hole 413 to realize pressure relief.

The opening assembly 42 comprises an opening rod 421, a first sealing part 422 and a first restoring spring 423. The opening rod 421 is movably arranged in the first through hole 413, and the first sealing part 422 is arranged on the opening rod 421 and is located in the water inlet cavity 411. The first restoring spring 423 is arranged between a first end of the opening rod 421 and a side wall of the water inlet cavity 411. The first restoring spring 423 abuts against the first end of the opening rod 421 and drives the first sealing part 422 to block the first through hole 413, thereby blocking water flow from flowing into the water outlet cavity 412 from the water inlet cavity 411 through the first through hole 413.

The specific installation structure of the first sealing part 422 is as follows: The first end of the opening rod 421 is formed with a first flange 4211 protruding radially from the opening rod 421, and the first sealing part 422 is located on a first side of the first flange 4211 facing the first through hole 413. The first restoring spring 423 is fitted on a second side of the first flange 4211 facing away from the first through hole 413.

The opening assembly 42 further comprises a diaphragm 424 and a button guide post 425. The water outlet cavity 412 is provided with a mounting hole 451 corresponding to a second end of the opening rod 421; the diaphragm 424 is sealingly fitted in an inner side of the mounting hole 451, and the second end of the opening rod 421 is movably fitted in an inner side of the diaphragm 424. The button guide post 425 is connected to an outer side of the diaphragm 424 and is movably arranged in the mounting hole 451. With the button guide post 425, the user's operating feel can be improved, and the direction of the force applied when pressing is ensured to be consistent with the direction of movement of the opening rod 421.

A first opening 4112 is formed at the water inlet cavity 411 corresponding to the first end of the opening rod 421. A back cover 43 is installed at the first opening 4112, and the back cover 43 is sealingly fitted with the first opening 4112. A back cover sealing ring 44 is arranged between an outer periphery of the back cover 43 and a side wall of the first opening 4112. Two ends of the first restoring spring 423 abut against the first end of the opening rod 421 and the back cover 43 respectively. The first opening 4112 and the back cover 43 are provided to facilitate the formation of the water inlet cavity 411 by molding and subsequent demolding process during manufacture.

A second opening 4121 is formed at the water outlet cavity 412 corresponding to the second end of the opening rod 421. A front cover 45 is installed at the second opening 4121, and the front cover 45 is sealingly fitted with the second opening 4121. The mounting hole 451 is provided on the front cover 45. The second opening 4121 and the front cover 45 are provided to facilitate the formation of the water outlet cavity 412 by molding and subsequent demolding process during manufacture.

The overpressure protection assembly 46 comprises a pressure relief cover 461, a second restoring spring 462 and a second sealing part 463. The pressure relief cover 461 is installed in the water outlet cavity 412. Two ends of the second restoring spring 462 abut against the pressure relief cover 461 and the second sealing part 463 respectively. The second restoring spring 462 abuts against the second sealing part 463 to block the pressure relief hole 4111. When the water pressure of the water inlet cavity 411 is greater than the elastic force of the second restoring spring 462, the pressure relief hole 4111 is opened.

In order to ensure the operation stability of the overpressure protection assembly 46, the pressure relief cover 461 is formed with a spring fixing pole 4611 at a position corresponding to the pressure relief hole 4111. The second restoring spring 462 has a first end which is sleeved on the spring fixing pole 4611 and a second end which is installed with a pressure relief stand 464. The second sealing part 463 is fitted on a side of the pressure relief stand 464 facing the pressure relief hole 4111.

A pressure relief cover sealing ring 465 is provided between an outer periphery of the pressure relief cover 461 and a side wall of the water outlet cavity 412. The pressure relief cover 461 is formed with a perforation 4612 at a position corresponding to the first through hole 413, and the opening rod 421 is movably arranged in the perforation 4612 and is movably fitted on an inner side of the diaphragm 424, thereby increasing airtightness of the opening valve 4 and preventing water from flowing out from places other than the first water outlet pipe 415. In addition, the movement direction of the opening rod 421 is limited by the first through hole 413 and the perforation 4612 to ensure the operation stability of the opening rod 421.

As shown in FIG. 6, when the opening valve 4 is closed, i.e. in the default state, the first restoring spring 423 abuts against the first flange 4211 of the opening rod 421 and drives the first sealing part 422 to block the first through hole 413. The second restoring spring 462 abuts against the pressure relief stand 464 and drives the second sealing part 463 to block the pressure relief hole 4111. The water flow enters the water inlet cavity 411 from the first water inlet pipe 414, and accumulates and stores pressure in the water inlet cavity 411.

Figure 7:
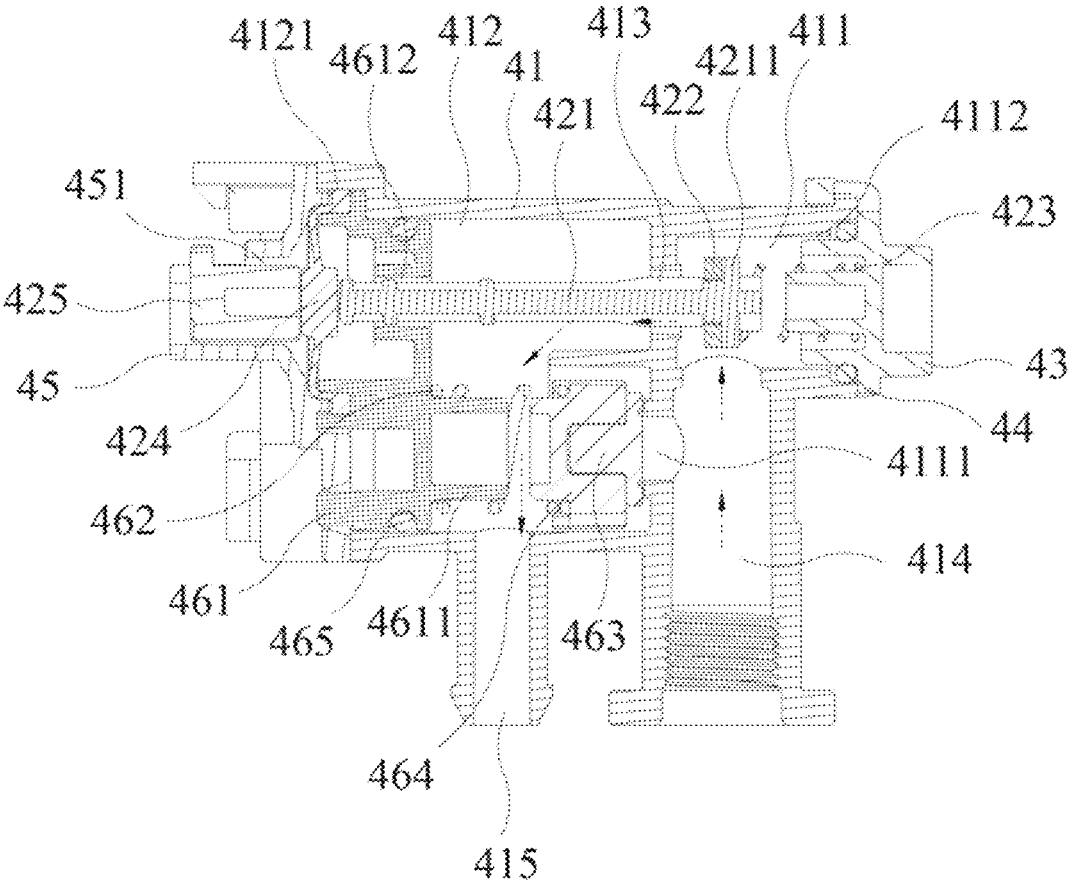
FIG. 7 is a schematic structural view of the open state of the opening valve of the present invention.

As shown in FIG. 7, when a force is applied to press on the position of the button guide post 425, the opening rod 421 moves towards the direction of the back cover 43, so that the first sealing part 422 is separated from the first through hole 413. Due to the pressure of the pressure flushing system, the water flow enters the water outlet cavity 412 from the water inlet cavity 411 through the first through hole 413, and is discharged from the first water outlet pipe 415 to realize pressure relief of the drain valve 3, and the drain 112 is opened correspondingly and starts to drain. When the force applied to the button guide post 425 is removed, i.e. the button guide post 425 is released, the first restoring spring 423 abuts against the first flange 4211 of the opening rod 421 and resets the first sealing part 422 to continue to block the first through hole 413.

Figure 8:
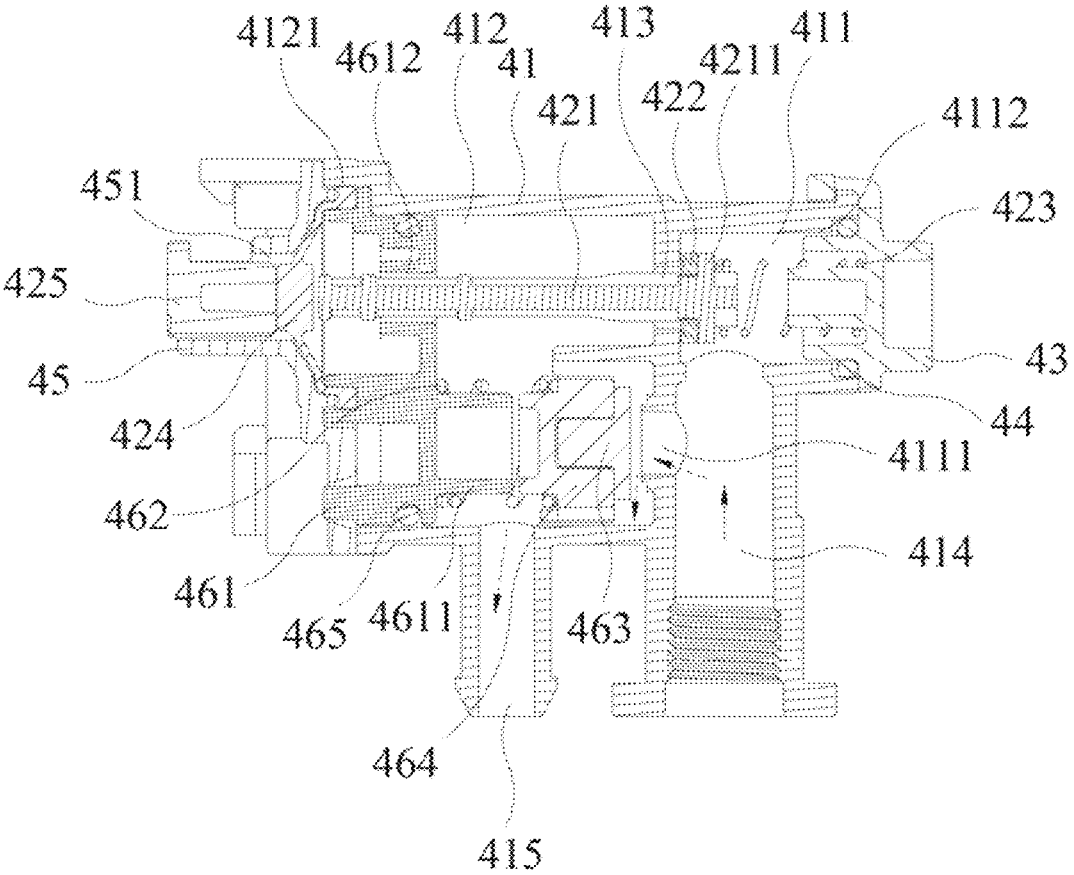
FIG. 8 is a schematic structural view of the pressure relief state of the opening valve of the present invention.
Figure 9:
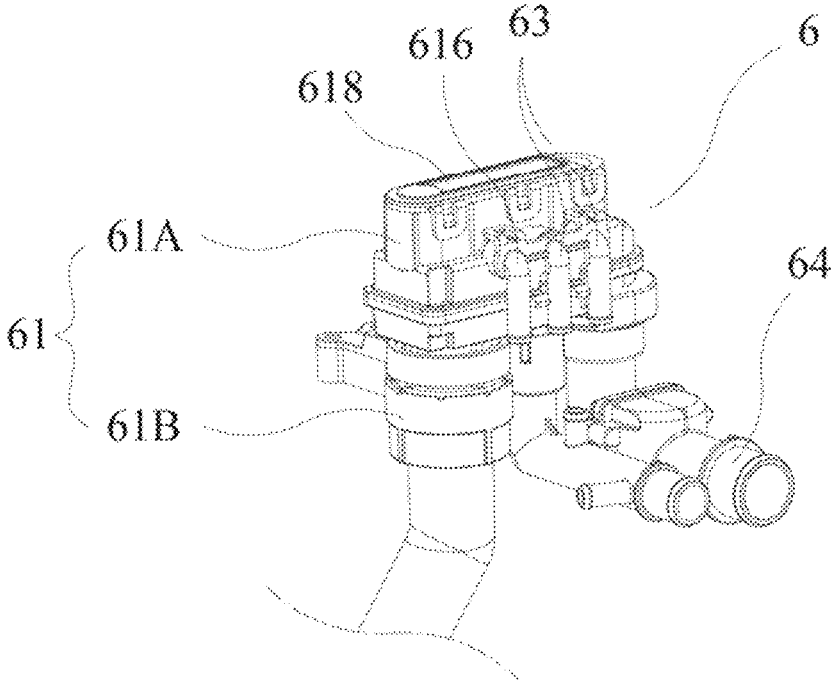
FIG. 9 is a perspective view of the water outlet box of the present invention.
Figure 10:
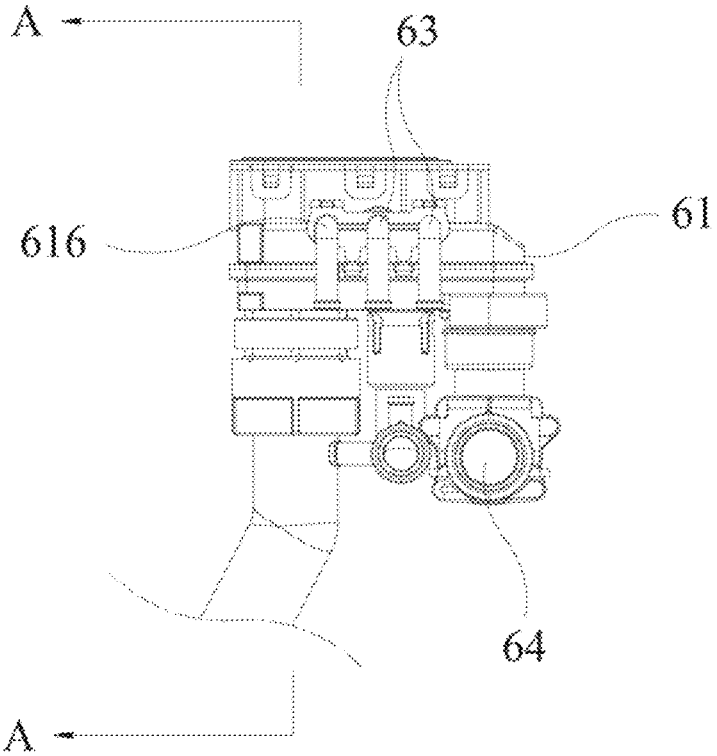
FIG. 10 is a front view of the water outlet box of the present invention.
Figure 11:
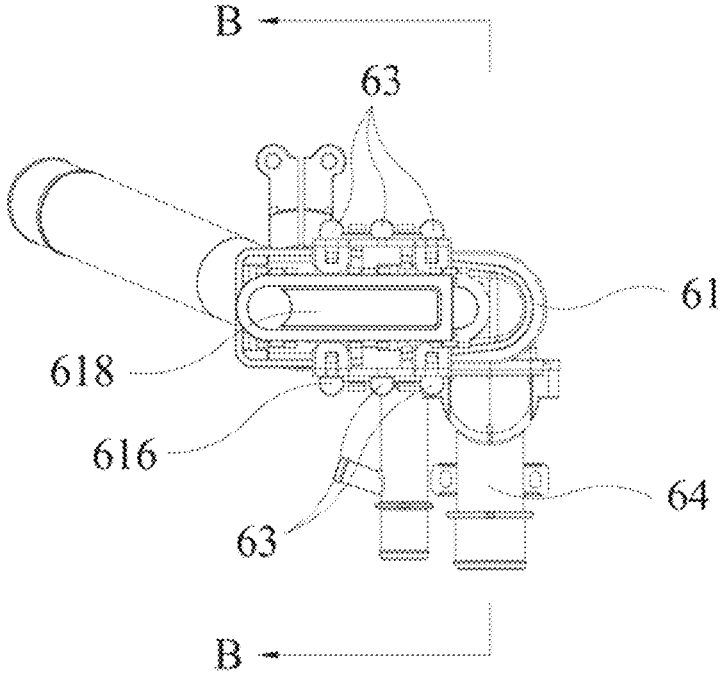
FIG. 11 is a top view of the water outlet box of the present invention.

As shown in FIG. 8, when the water pressure inside the water inlet cavity 411 is too high (i.e. the water pressure inside the pressure flushing system is too high), if the water pressure is greater than the pressure of the second restoring spring 462, the second sealing part 463 will be separated from the pressure relief hole 4111. The water flow then enters the water outlet cavity 412 from the water inlet cavity 411 through the pressure relief hole 4111, and is discharged from the first water outlet pipe 415 to realize automatic pressure relief of the pressure flushing system, and correspondingly, the drain valve 3 opens the drain 112 and starts to drain to avoid excessive pressure inside the pressure flushing system to rupture the pipes and parts under pressure.

The opening valve 4 of the above structure controls the opening and closing of the first through hole 413 by the opening assembly 42 to realize the control by purely mechanical structure. The state can be switched through manual operation, which can save energy, and the structure is simple, the operation is convenient and the production cost is low. With the pressure relief hole 4111 and the overpressure protection assembly 46, the pressure flushing system installed with the opening valve 4 has the overpressure protection function. When the internal pressure is too high, it will automatically relief the pressure to protect the pipes and parts and extend its service life.

The pressure flushing system further comprises a pressure stabilizing valve 5, which is arranged between a water inlet of the combination valve 2 and a water source of the pressure flushing system to ensure stable water pressure inside the water storage structure 1, i.e. to ensure stable internal pressure of the pressure flushing system to avoid potential safety hazards.

The pressure flushing system further comprises a water outlet box 6, and the embodiment of the water outlet box 6 is as follows:

As shown in FIGS. 9 to 15, the water outlet box 6 comprises a water outlet box main body 61 and a first one-way valve assembly 62. The water outlet box main body 61 is formed with a water-passing cavity 611, a second water inlet 612, at least one water outlet 613 and a vent 614, with the second water inlet 612, the water outlet 613 and the vent 614 all being in communication with the water-passing cavity 611, and the second water inlet 612 is in communication with the drain 112. The first one-way valve assembly 62 and the second water inlet 612 are arranged relative to each other to open or block the second water inlet 612. When the pressure flushing system finishes flushing, the first one-way valve assembly 62 blocks the second water inlet 612. The vent 614 is provided at a top part of the water-passing cavity 611 and is open to atmosphere. When the toilet is blocked or the tap water supply stops, negative pressure is generated inside the pressure flushing system, and air from the atmosphere enters through the vent 614. The first one-way valve assembly 62 blocks the second water inlet 612 by air pressure to prevent siphoning. In addition, the air pressure in the water-passing cavity 611 is consistent with the atmosphere to prevent negative pressure from being generated, and backflow of water in the toilet is prevented.

The water outlet box main body 61 is provided with several second water inlet pipes 63 in communication with the functional devices of the pressure flushing system, and the second water inlet pipes 63 are in communication with the water-passing cavity 611 to realize the pressure relief or water discharge of the functional devices. The functional devices comprises at least one of the drain valve 3, the opening valve 4, a solenoid valve, and the pressure stabilizing valve 5, so as to realize the pressure stability inside the pressure flushing system and keep the water flow inside the system.

In order to prevent the inflow of the second water inlet 612 and the discharged water of the functional devices from colliding with each other when the pressure flushing system is draining, and prevent the functions of the functional devices from being affected by the backflow of the discharged water, the water-passing cavity 611 is divided into a first cavity 611A and a second cavity 611B. The second cavity 611B is located above the first cavity 611A, and a second through hole 615 is provided between the first cavity 611A and the second cavity 611B. The second water inlet 612 and the water outlet 613 are both in communication with the first cavity 611A, wherein the second water inlet 612 is provided relative to the second through hole 615. The vent 614 is provided at a top part of the second cavity 611B, and the second water inlet pipes 63 are in communication with the second cavity 611B. The first one-way valve assembly 62 is provided relative to the second through hole 615 to open or block the second through hole 615. When the pressure flushing system starts flushing, the first one-way valve assembly 62 blocks the second through hole 615.

The water outlet box 6 further comprises a second water outlet pipe 64 which is in communication with the water outlet 613. The second water outlet pipe 64 is provided with a second one-way valve assembly 65. The second one-way valve assembly 65 blocks the water outlet 613 when the water flow in the second water outlet pipe 64 flows to the water-passing cavity 611, thereby allowing the water flow of the second water outlet pipe 64 to discharge only but disallowing backflow, thereby further improving the anti-siphoning effect of the water outlet box 6.

Figure 24:
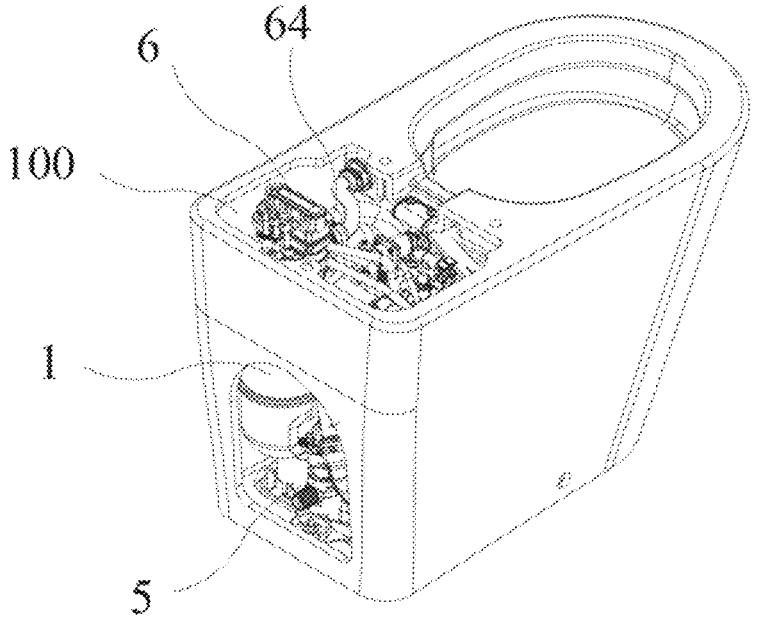
FIG. 24 is a perspective view of the toilet of the present invention.
Figure 25:
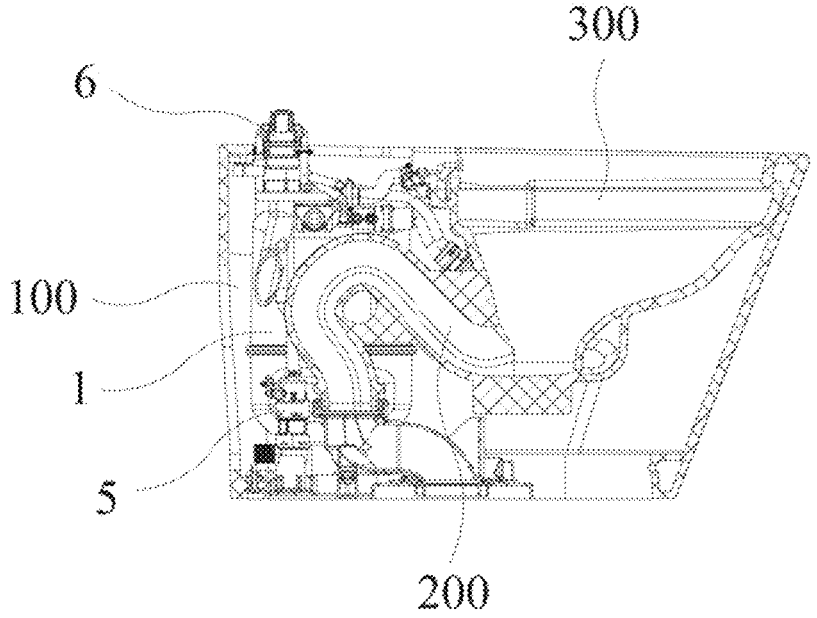
FIG. 25 is a cross-sectional view of the toilet of the present invention.

The water outlet box main body 61 is provided with a discharge pipe 616, and two ends of the discharge pipe 616 are in communication with the second water outlet pipe 64 and the second cavity 611B respectively, so as to realize the rapid discharge of water and air in the second cavity 611B, which eventually flows into the toilet for flushing. When the number of water outlets 613 is greater than one (i.e. the number of the second water outlet pipes 64 is greater than one; for example, when there are two second water outlet pipes 64 as shown in FIGS. 24 and 25, one being in communication with a rim flushing pipe 300 of the toilet and one being in communication with a main flushing pipe 200 of the toilet), the discharge pipe 616 is eventually in communication with the rim flushing pipe 300 of the toilet.

The water outlet box main body 61 is divided into an upper shell 61A and a lower shell 61B, and the upper shell 61A and the lower shell 61B cooperate with each other in a sealed manner. The second cavity 611B is formed in the upper shell 61A, and the first cavity 611A is formed in the lower shell 61B, so that the first cavity 611A and the second cavity 611B are formed when demolding the water outlet box main body 61 during manufacture.

The first one-way valve assembly 62 comprises a valve sheet 621 and sealing rubber pads 622. Two sides of the valve sheet 621 are each provided with one of the sealing rubber pads 622. The sealing rubber pads 622 on the two sides movably blocks the second water inlet 612 and the second through hole 615 respectively.

The water outlet box 6 further comprises a third one-way valve assembly 66. The third one-way valve assembly 66 is provided relative to the vent 614 to open or block the vent 614. When the pressure flushing system finishes flushing, the third one-way valve assembly 66 opens the vent 614. The third one-way valve assembly 66 comprises a movable member 661 and a sealing ring 662. The movable member 661 is movably installed in the vent 614 and the sealing ring 662 is sleeved on an outer periphery of the movable member 661 and movably blocks the vent 614 along with the movement of the movable member 661. An upper end of the movable member 661 is formed with a hook 6611 which is movably hooked on an upper peripheral edge of the vent 614 to prevent the movable member 661 from downwardly disengaging from the vent 614 by gravity, thereby ensuring the operation stability of the third one-way valve assembly 66.

An overflow groove 617 is formed on a top part of the water outlet box main body 61, and the vent 614 is in communication with the overflow groove 617. The overflow groove 617 is used to temporarily store the water flowing out of the vent 614 to prevent the water from splashing from the vent 614, thereby preventing the operation status of other functional devices of the pressure flushing system from being affected. A water blocking piece 618 is provided at an opening of the overflow groove 617, and the water blocking piece 618 partially covers the opening of the overflow groove 617 to achieve ventilation and further prevent water splashing.

Figure 12:
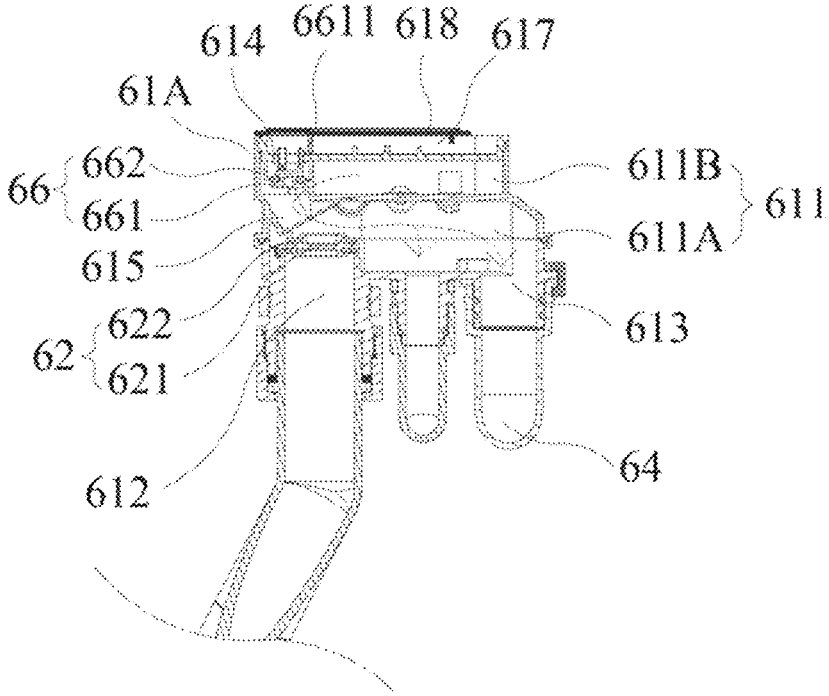
FIG. 12 is a schematic view of the water flow in the water outlet box main body when the pressure flushing system is in the water storage state (section A-A in FIG. 10).
Figure 13:
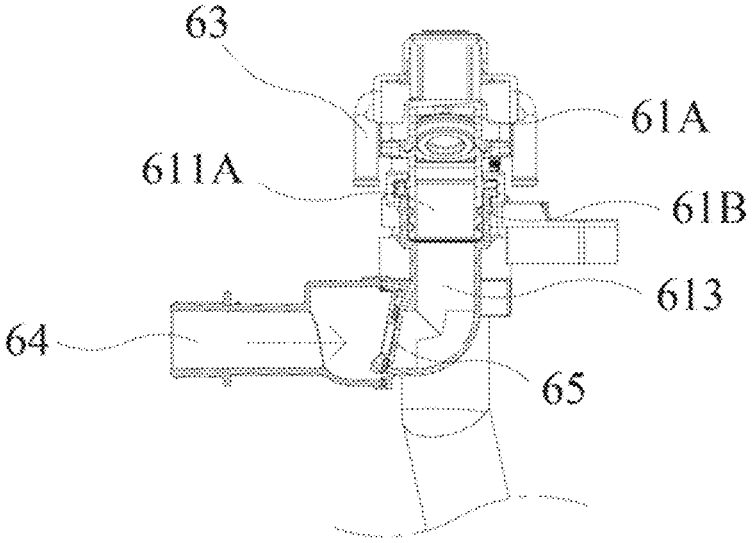
FIG. 13 is a schematic view of the water flow in the second outlet pipe when the pressure flushing system is in the water storage state (section B-B in FIG. 11).

As shown in FIGS. 12 and 13, when the pressure flushing system is in the water storage state, the first one-way valve assembly 62 swings downward under the action of gravity and blocks the second water inlet 612, and the third one-way valve assembly 66 moves downward by gravity and opens the vent 614. At this time, the first cavity 611A and the second cavity 611B are connected to the atmosphere, and a small amount of water inflow in the second cavity 611B, i.e. the water flow released from pressure by the drain valve 3, the opening valve 4, the solenoid valve, and the pressure stabilizing valve 5, respectively flows into the first cavity 611A and the discharge pipe 616, and is eventually discharged from the water outlet 613. In addition, the second one-way valve assembly 65 swings downward under the action of gravity and counter-current water pressure, and eventually blocks the water outlet 613. When the number of water outlets 613 is greater than one, what is blocked is the water outlet 613 which is in communication with the main flushing pipe 200 of the toilet.

Figure 14:
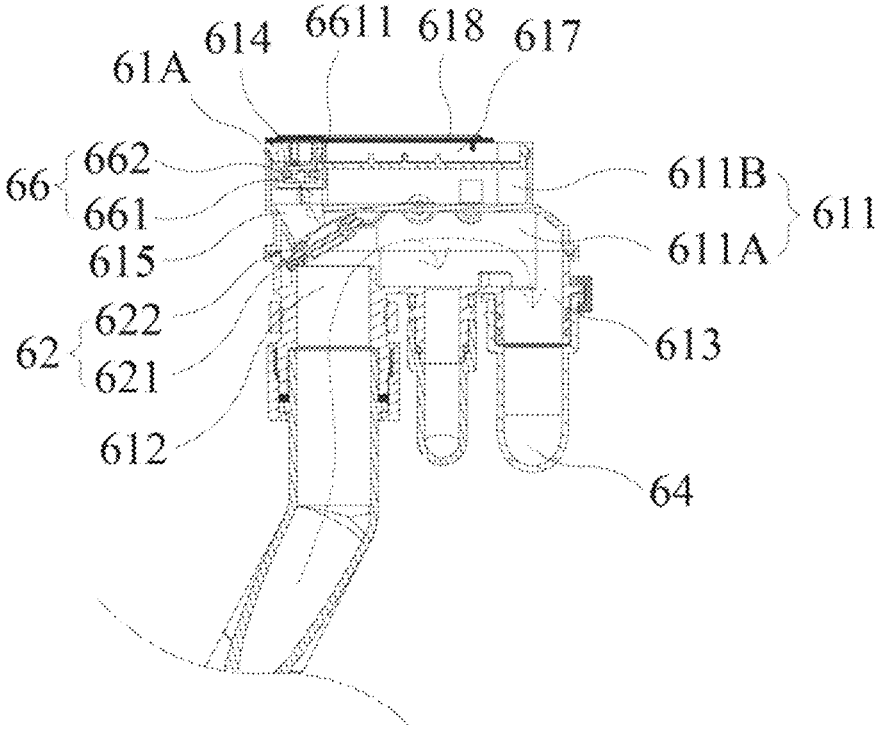
FIG. 14 is a schematic view of the water flow in the water outlet box main body when the pressure flushing system is in the drainage state (section A-A in FIG. 10).
Figure 15:
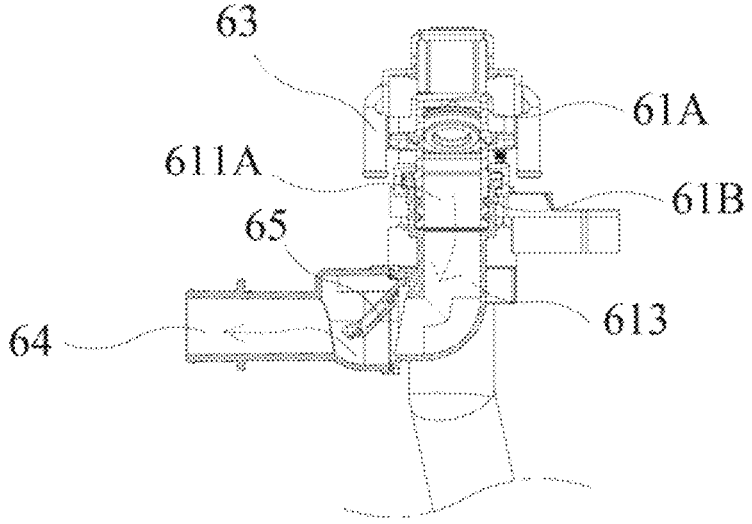
FIG. 15 is a schematic view of the water flow in the second outlet pipe when the pressure flushing system is in the drainage state (section B-B in FIG. 11).

As shown in FIGS. 14 and 15, when the pressure flushing system is in a draining state, the first one-way valve assembly 62 swings upward under the action of water pressure, and the water flow enters the first cavity 611A and is diverted to the second cavity 611B and the water outlet 613. Only a small amount of water flows into the second cavity 611B because the first one-way valve assembly 62 will be lifted by the water flow to block the second through hole 615. The water flow in the second cavity 611B lifts up the third one-way valve assembly 66 to block the vent 614 to prevent the water flow from splashing out of the water outlet box main body 61. At this time, the second one-way valve assembly 65 is pushed open by the water flow to achieve drainage.

By arranging the first one-way valve assembly 62 in the water-passing cavity 611 to movably block the second water inlet 612, the anti-siphoning function of the water outlet box 6 can realized; and by setting the vent 614 to connect to the atmosphere, it can be ensured that the pressure inside the water-passing cavity 611 is consistent with the atmosphere, and no negative pressure will be generated, thereby preventing the water flow from the water outlet 613 from being sucked backwards. The water outlet box 6 is provided independent of the water storage structure 1 of the pressure flushing system, and it can be installed according to the required height, which further improves the anti-siphoning effect.

In addition, connecting the functional devices of the pressure flushing system to the water-passing cavity 611 can ensure the pressure balance inside the pressure flushing system. When the number of water outlets 13 is multiple, the water outlet box 6 can realize the function of water flow diversion and supply water to different pipes of the toilet.

Figure 16:
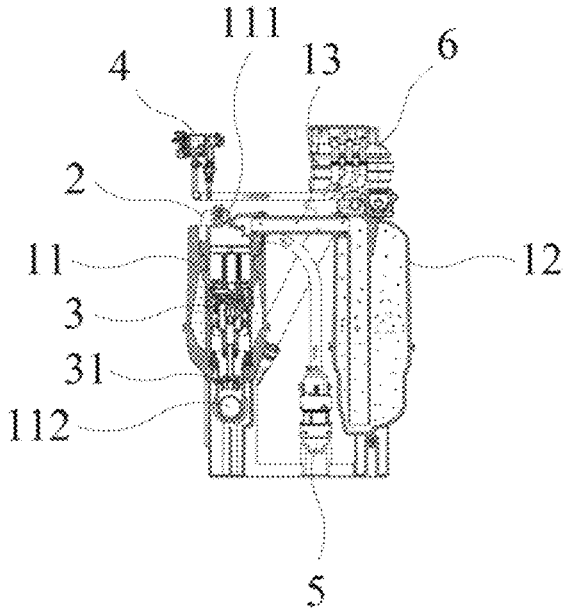
FIG. 16 is a schematic view of the water storage state of the first embodiment of the pressure flushing system.

As shown in FIG. 16, the water intake process of the first embodiment of the pressure flushing system is as follows: water from the water source pipeline enters the combination valve 2 through the pressure stabilizing valve 5, and flows into the first container 11 and the drain valve 3 respectively, driving the piston 31 of the drain valve 3 to block the drain 112. The first container 11 stores water and squeezes the air inside the first container 11 upwards to enter the communicating member 13. After the first container 11 is full of water, the second container 12 starts to store water and squeezes the air inside the second container 12 upwards, so that the air is stored in the upper part of the second container 12. At this time, both the communicating member 13 and the upper part of the second container 12 have compressed air.

Figure 17:
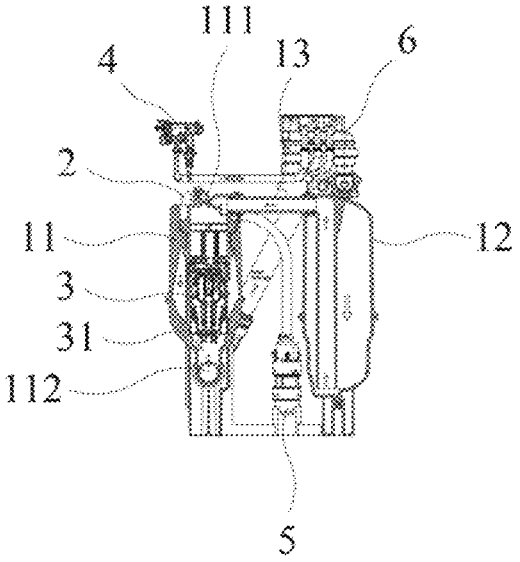
FIG. 17 is a schematic view of the drainage state of the first embodiment of the pressure flushing system.

As shown in FIG. 17, the draining process of the first embodiment of the pressure flushing system is as follows: the opening valve 4 is operated to release the pressure of the drain valve 3. The piston 31 is separated from the drain 112, and the water in the first container 11 is quickly discharged. At the same time, the pressure of the communicating member 13 is relieved, and the compressed air in the upper part of the second container 12 pushes the water in the lower part to produce a siphoning effect, so that the water in the lower part of the second container 12 is transported to the first container and discharged from the drain 112. The water in the first container 11 passes through the second water inlet pipes 63, enters the water distribution box 3, flows out from the second water outlet pipe 64, and eventually enters the toilet for flushing.

Figure 18:
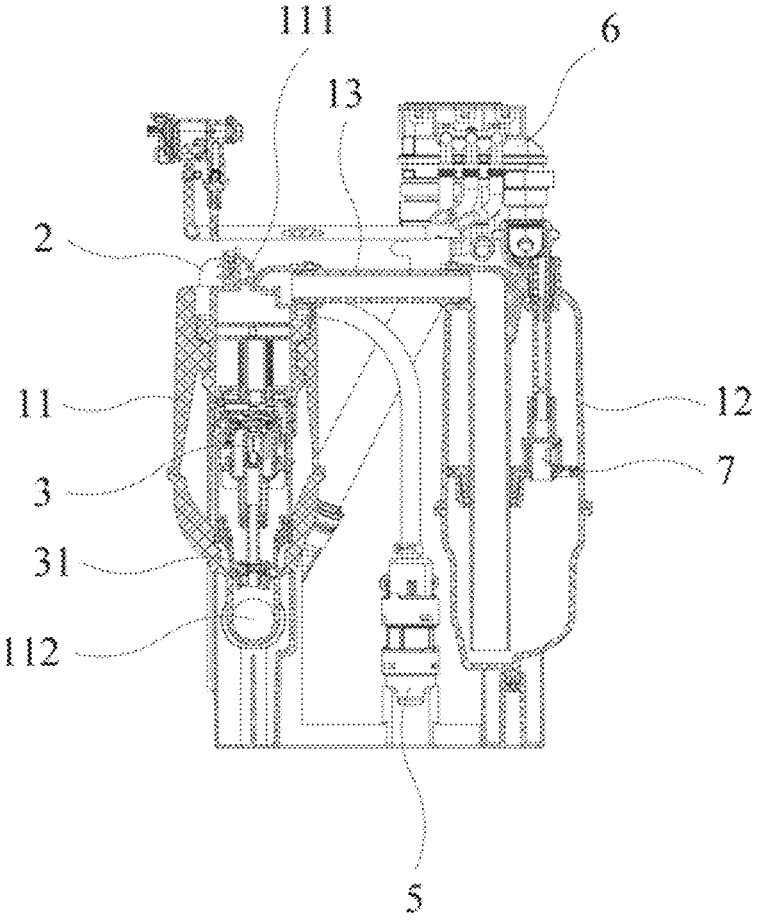
FIG. 18 is a schematic structural view of the second embodiment of the pressure flushing system of the present invention.
Figure 19:
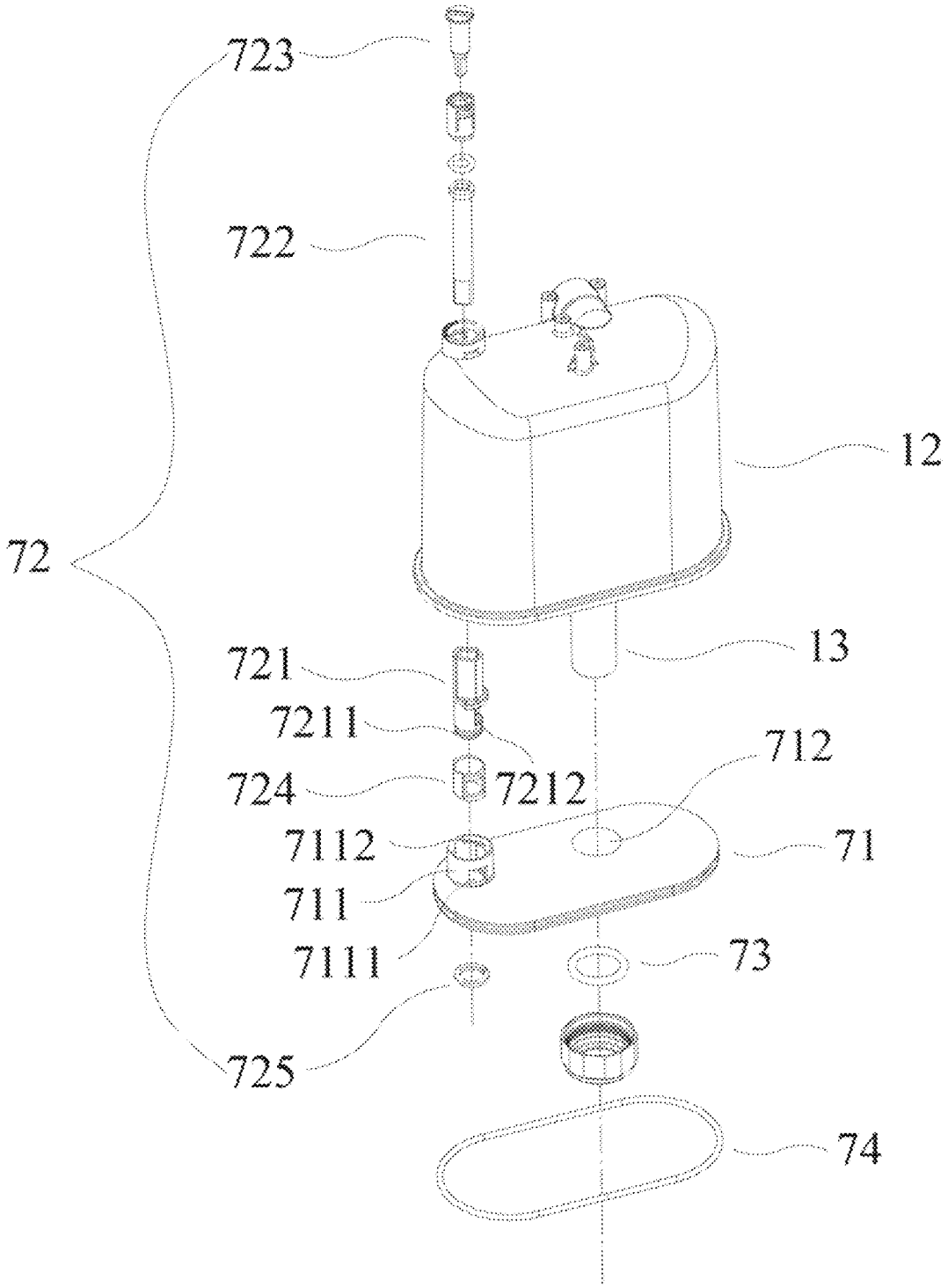
FIG. 19 is a dissembled view of the adjusting device of the present invention (including the second container).
Figure 20:
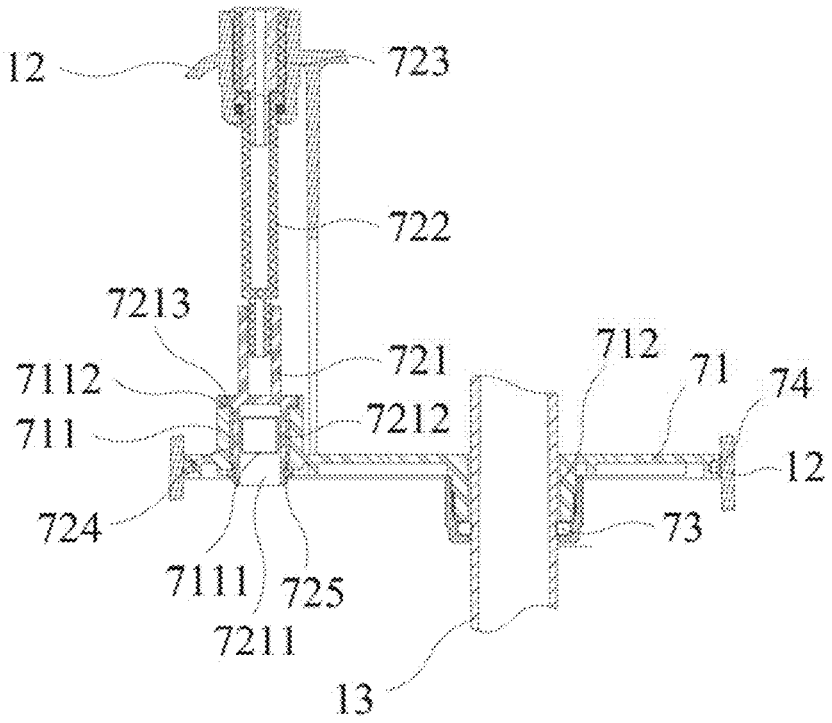
FIG. 20 is a schematic structural view of the fully open state of the adjusting device of the present invention.
Figure 21:
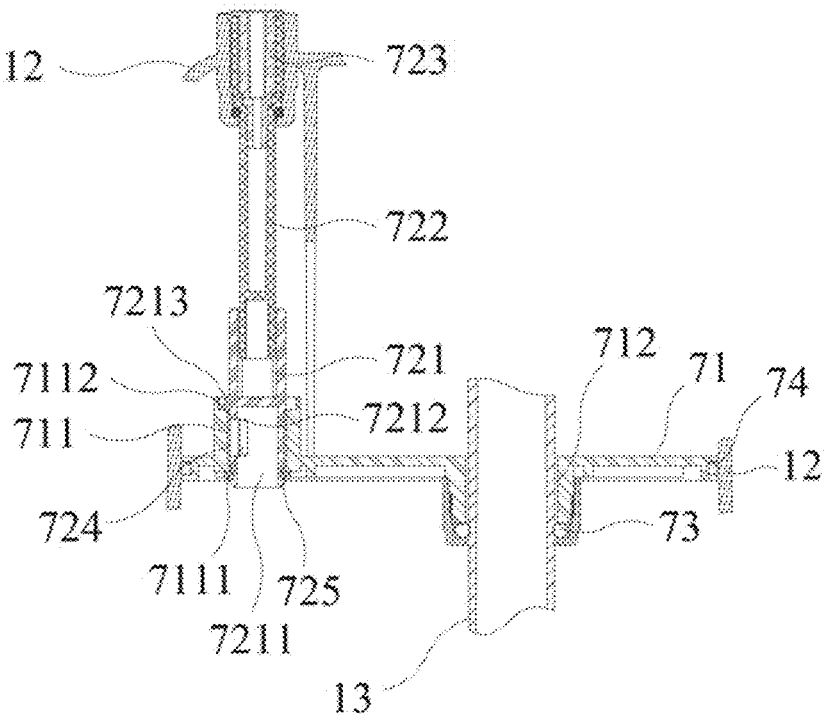
FIG. 21 is a schematic structural view of the fully closed state of the adjusting device of the present invention.

As shown in FIG. 18, the second embodiment of the pressure flushing system differs from the first embodiment in that an adjusting device 7 is provided in the second container 12. The specific implementation of the adjusting device 7 is as follows:

As shown in FIGS. 19 to 21, the adjusting device 7 comprises a water-gas partition 71 that divides the second container 12 into a water chamber and an air chamber, and an exhaust adjustment assembly 72. The water-gas partition 71 is provided with an air outlet 7111 communicating with the water chamber and the air chamber of the second container 12; the exhaust adjustment assembly 72 is arranged relative to the air outlet 7111 and movably adjusts exhaust volume of the air outlet 7111.

The exhaust adjustment assembly 72 has a lower end which is installed at the air outlet 7111 and an upper end which penetrates upwardly out of the second container 12. By operating the part of the exhaust adjustment assembly 72 outside an upper surface of the second container 12, the exhaust volume of the air outlet 7111 of the water-gas partition 71 inside the second container 12 can be adjusted. The upper end of the exhaust adjustment assembly 72 is located on a top part of the second container 12, which is more convenient for users to operate and occupies a smaller lateral space, which will not interfere with the installation of the water storage structure 1 in the toilet ceramics.

The water-gas partition 71 is formed with an installation pipe 711, and the air outlet 7111 is provided on a side wall of the installation pipe 711. The exhaust adjustment assembly 72 cooperates with the installation pipe 711 in a sealed manner, and is provided with an exhaust pipe 7211 communicating with the water chamber. The exhaust pipe 7211 is formed with an air inlet 7212 corresponding to the air outlet 7111. The exhaust adjustment assembly 72 is used to adjust the relative position of the air inlet 7212 and the air outlet 7111, thereby changing the cross-sectional size of the air outlet 7111. The installation pipe 711 has a vertical upward opening, and the exhaust adjustment assembly 72 is installed in the opening and vertically penetrates upwardly out of the second container 12.

The exhaust adjustment assembly 72 comprises an adjustment valve 721 and an adjustment button. In this embodiment, the adjustment button comprises an adjusting rod 722 and a knob 723. The adjustment valve 721 is connected to a first end of the adjusting rod 722 and is fitted in the installation pipe 711 in a sealed manner. The exhaust pipe 7211 is provided on the adjustment valve 721. A second end of the adjusting rod 722 passes through the second container 12 and connects with the knob 723. The second end of the adjusting rod 722 cooperates with the second container 12 in a sealed manner (or an outer periphery of the knob 723 cooperates with the second container 12 in a sealed manner). In addition, the adjustment valve 721 is connected to the knob 723 through the adjusting rod 722, that is, the adjusting rod 722 and the knob 723 of the adjustment button are provided separately. Of course, the adjusting rod 722 and the knob 723 of the adjustment button can also be provided integrally, so that the adjustment valve 721 is directly connected with the adjustment button.

An outer periphery of the adjustment valve 721 is sleeved with an adjustment valve sealing ring 724, and the adjustment valve sealing ring 724 is sealingly fitted between the adjustment valve 721 and the installation pipe 711 to improve the sealing performance of the product. The air inlet 7212 penetrates the adjustment valve sealing ring 724.

An installation step 7112 is provided at an opening at a first end of the installation pipe 711. A second flange 7213 is provided at the adjustment valve 721 at a position corresponding to the installation step 7112, and the second flange 7213 is fitted on the installation step 7112. The adjustment valve 721 penetrates into the installation pipe 711, and is fitted to a second end of the installation pipe 711 in a position-limiting manner through a C-type buckle 725. In this way, the adjustment valve 721 can be fitted in the installation pipe 711 in a position-limiting manner, and the stability of the adjustment valve 721 during rotation is improved.

The water-gas partition 71 is formed with a third through hole 712 for the communicating member 13 to pass through, and the communicating member 13 cooperates with the third through hole 712 in a sealed manner by means of a first sealing ring 73, thereby preventing the compressed air in the air chamber from entering the water chamber through the third through hole 712.

The water-gas partition 71 cooperates with a side wall of the second container 12 in a sealed manner by means of a second sealing ring 74.

As shown in FIGS. 20 and 21, the adjusting device 7 realizes the water-gas isolation of the second container 12 through the water-gas partition 71, and realizes the adjustment of the relative position of the air inlet 7212 and the air outlet 7111 through the rotation of the adjustment valve 721 perpendicular to the vertical direction. The specific operation is as follows: by turning the knob 723, the adjusting rod 722 drives the adjustment valve 721 to rotate, which can change the relative position of the air inlet 7212 and the air outlet 7111, and then further change the cross-sectional size of the air outlet 7111, i.e. the exhaust volume. Of course, the exhaust adjustment assembly 72 is not limited to the above structure, any device or structure which achieves manual adjustment of the exhaust volume of the air outlet 7111 is applicable to the adjusting device 7.

The adjusting device 7 can adjust the exhaust volume of the air outlet 7111 by means of the exhaust adjustment assembly 72, that is, adjust the release speed of the compressed air, thereby achieving adjustment of the drainage speed of the water storage structure 1 according to the demand and improving the compatibility between the water storage structure 1 and toilets of different pipe types. It has the advantages of simple structure and convenient operation.

Figure 22:
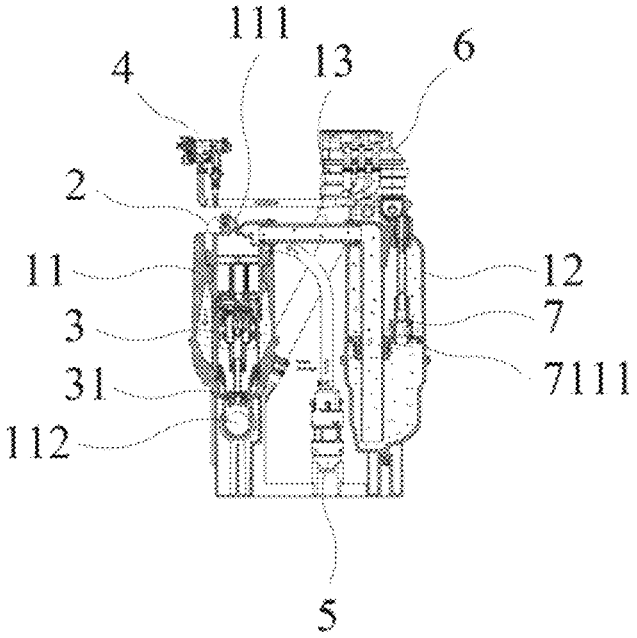
FIG. 22 is a schematic view of the water storage state of the second embodiment of the pressure flushing system.

As shown in FIG. 22, the water intake process of the second embodiment of the pressure flushing system is as follows: water from the water source pipeline enters the combination valve 2 through the pressure stabilizing valve 5, and flows into the first container 11 and the drain valve 3 respectively, driving the piston 31 of the drain valve 3 to block the drain 112. The first container 11 stores water and squeezes the air inside the first container 11 upwards to enter the communicating member 13. After the first container 11 is full of water, the second container 12 starts to store water and squeezes the air inside the second container 12 upwards through the air outlet 7111, so that the air is pressured above the water-gas partition 71. At this time, both the communicating member 13 and the upper part of the second container 12 have compressed air.

Figure 23:
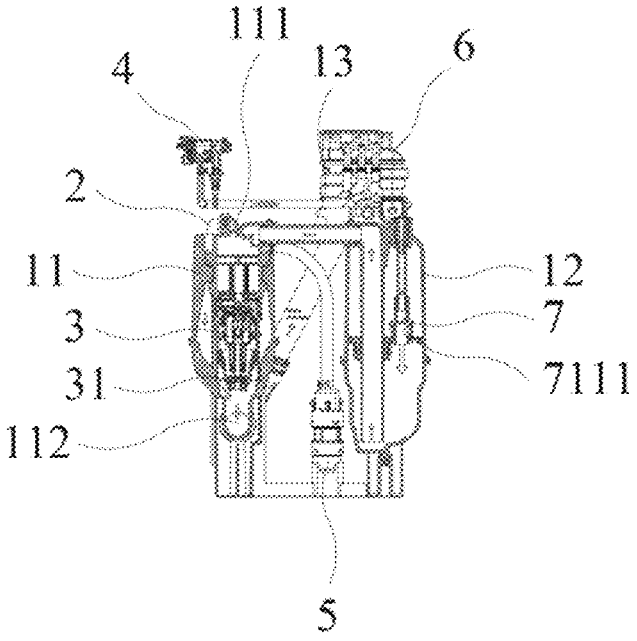
FIG. 23 is a schematic view of the drainage state of the second embodiment of the pressure flushing system.

As shown in FIG. 23, the drainage process of the second embodiment of the pressure flushing system is as follows: the opening valve 4 is operated to release the pressure of the drain valve 3. The piston 31 is separated from the drain 112, and the water in the first container 11 is quickly discharged. At the same time, the pressure of the communicating member 13 is relieved, and the compressed air in the upper part of the second container 12 is discharged through the air outlet 7111 and pushes the water in the lower part to produce a siphoning effect, so that the water in the lower part of the second container 12 is transported to the first container and discharged from the drain 112. The water in the first container 11 passes through the second water inlet pipes 63, enters the water distribution box 3, flows out from the second water outlet pipe 64, and eventually enters the toilet for flushing.

As shown in FIGS. 24 and 25, the pressure flushing system can be applied to a toilet. The pressure flushing system is installed in the accommodating cavity 100 of the toilet, and the drain 112 of the water storage structure 1 is in communication with a flushing pipe of the toilet. The flushing pipe of the toilet in this embodiment comprises a main flushing pipe 200 and a rim flushing pipe 300. When the water outlet box 6 is provided, the multiple second water outlet pipes 64 of the water outlet box 6 are respectively in communication with the main flushing pipe 200 and the rim flushing pipe 300 of the toilet.

The above-mentioned embodiments and drawings do not limit the product form and style of the present invention, and any appropriate changes or modifications made by those of ordinary skill in the art should be regarded as not departing from the patent scope of the present invention.

What is claimed is:

1. A pressure flushing system, comprising a first container, a second container and a communicating member that communicates with the first container and the second container; the first container is formed with a first water inlet and a drain; water flows into the first container from the first water inlet; and the water from the first container flows into the second container through the communicating member; gas in the first container and the second container is gradually compressed and stored in an upper part of the second container during a water intake process, and the compressed gas pushes the water in the first container and the second container to be discharged from the drain when draining; the pressure flushing system further comprises a water outlet box; the water outlet box comprises a water outlet box main body and a first one-way valve assembly; the water outlet box main body is formed with a water-passing cavity, a second water inlet, at least one water outlet and a vent, with the second water inlet, the water outlet and the vent all being in communication with the water-passing cavity, and the second water inlet is in communication with the drain; the first one-way valve assembly is arranged relative to the second water inlet to open or block the second water inlet; when the pressure flushing system finishes flushing, the first one-way valve assembly blocks the second water inlet; the vent is arranged at a top part of the water-passing cavity and is open to atmosphere.

2. The pressure flushing system as in claim 1, wherein the communicating member has a first end which is arranged at a top part of the first container and a second end which extends into an interior of the second container and is close to a bottom part of the second container.

3. The pressure flushing system as in claim 1, further comprising a drain valve which is arranged in the first container to open or close the drain.

4. The pressure flushing system as in claim 3, further comprising an opening valve for controlling pressure relief of the drain valve; the opening valve comprises a valve body, an opening assembly and an overpressure protection assembly; the valve body is formed with a water inlet cavity and a water outlet cavity, and the water inlet cavity and the water outlet cavity are communicated through a first through hole; the water inlet cavity is provided with a first water inlet pipe communicating with the drain, and the water outlet cavity is provided with a first water outlet pipe; the opening assembly is arranged relative to the first through hole and opens or closes the first through hole; pressure of the drain is relieved when the first through hole is opened; the water inlet cavity is formed with a pressure relief hole; the overpressure protection assembly is arranged relative to the pressure relief hole and closes the pressure relief hole, and opens the pressure relief hole when pressure of the water inlet cavity is greater than a preset value; when the pressure relief hole is opened, the water inlet cavity and the first water outlet pipe are in communication with each other.

5. The pressure flushing system as in claim 4, wherein the first through hole and the pressure relief hole are both arranged vertical to a direction of inlet water flow, and the pressure relief hole is arranged upstream of the inlet water flow relative to the first through hole.

6. The pressure flushing system as in claim 1, wherein the water outlet box main body is provided with several second water inlet pipes in communication with functional devices of the pressure flushing system, and the second water inlet pipes are in communication with the water cavity to realize pressure relief or water discharge of the functional devices; the functional devices comprises at least one of a drain valve, the opening valve, a solenoid valve and a pressure stabilizing valve of the pressure flushing system.

7. The pressure flushing system as in claim 6, wherein the water-passing cavity is divided into a first cavity and a second cavity; the second cavity is located above the first cavity, and a second through hole is provided between the first cavity and the second cavity; the second water inlet and the water outlet are both in communication with the first cavity, wherein the second water inlet is provided relative to the second through hole; the vent is provided at a top part of the second cavity, and the second water inlet pipes are in communication with the second cavity; the first one-way valve assembly is provided relative to the second through hole to open or block the second through hole; when the pressure flushing system starts flushing, the first one-way valve assembly blocks the second through hole.

8. The pressure flushing system as in claim 2, wherein the water outlet box main body is provided with several second water inlet pipes in communication with functional devices of the pressure flushing system, and the second water inlet pipes are in communication with the water cavity to realize pressure relief or water discharge of the functional devices; the functional devices comprises at least one of a drain valve, the opening valve, a solenoid valve and a pressure stabilizing valve of the pressure flushing system.

9. The pressure flushing system as in claim 8, wherein the water-passing cavity is divided into a first cavity and a second cavity; the second cavity is located above the first cavity, and a second through hole is provided between the first cavity and the second cavity; the second water inlet and the water outlet are both in communication with the first cavity, wherein the second water inlet is provided relative to the second through hole; the vent is provided at a top part of the second cavity, and the second water inlet pipes are in communication with the second cavity; the first one-way valve assembly is provided relative to the second through hole to open or block the second through hole; when the pressure flushing system starts flushing, the first one-way valve assembly blocks the second through hole.

10. The pressure flushing system as in claim 3, wherein the water outlet box main body is provided with several second water inlet pipes in communication with functional devices of the pressure flushing system, and the second water inlet pipes are in communication with the water cavity to realize pressure relief or water discharge of the functional devices; the functional devices comprises at least one of the drain valve, the opening valve, a solenoid valve and a pressure stabilizing valve of the pressure flushing system.

11. The pressure flushing system as in claim 10, wherein the water-passing cavity is divided into a first cavity and a second cavity; the second cavity is located above the first cavity, and a second through hole is provided between the first cavity and the second cavity; the second water inlet and the water outlet are both in communication with the first cavity, wherein the second water inlet is provided relative to the second through hole; the vent is provided at a top part of the second cavity, and the second water inlet pipes are in communication with the second cavity; the first one-way valve assembly is provided relative to the second through hole to open or block the second through hole; when the pressure flushing system starts flushing, the first one-way valve assembly blocks the second through hole.

12. The pressure flushing system as in claim 1, wherein the second container is provided with an adjusting device therein; the adjusting device comprises a water-gas partition that divides the second container into a water chamber and an air chamber, and an exhaust adjustment assembly; the water-gas partition is provided with an air outlet communicating with the water chamber and the air chamber of the second container; the exhaust adjustment assembly is arranged relative to the air outlet and movably adjusts exhaust volume of the air outlet; the water-gas partition is formed with a third through hole for the communicating member to pass through, and the communicating member cooperates with the third through hole in a sealed manner.

13. The pressure flushing system as in claim 2, wherein the second container is provided with an adjusting device therein; the adjusting device comprises a water-gas partition that divides the second container into a water chamber and an air chamber, and an exhaust adjustment assembly; the water-gas partition is provided with an air outlet communicating with the water chamber and the air chamber of the second container; the exhaust adjustment assembly is arranged relative to the air outlet and movably adjusts exhaust volume of the air outlet; the water-gas partition is formed with a third through hole for the communicating member to pass through, and the communicating member cooperates with the third through hole in a sealed manner.

14. The pressure flushing system as in claim 3, wherein the second container is provided with an adjusting device therein; the adjusting device comprises a water-gas partition that divides the second container into a water chamber and an air chamber, and an exhaust adjustment assembly; the water-gas partition is provided with an air outlet communicating with the water chamber and the air chamber of the second container; the exhaust adjustment assembly is arranged relative to the air outlet and movably adjusts exhaust volume of the air outlet; the water-gas partition is formed with a third through hole for the communicating member to pass through, and the communicating member cooperates with the third through hole in a sealed manner.

15. A toilet provided with an accommodating cavity and a flushing pipe, wherein the toilet further comprises the pressure flushing system as in claim 1; the pressure flushing system is installed in the accommodating cavity, and the drain of the first container is in communication with the flushing pipe of the toilet.

16. The toilet as in claim 15, wherein the accommodating cavity is formed at a rear part of the toilet, and the first container and the second container are located on two sides of toilet sewage pipe respectively.

* * * * *